US008774662B2

(12) United States Patent
Sakuraba et al.

(10) Patent No.: US 8,774,662 B2
(45) Date of Patent: Jul. 8, 2014

(54) FIXING DEVICE, IMAGE FORMING APPARATUS, AND METHOD OF CONTROLLING FIXING DEVICE

(75) Inventors: Jyunya Sakuraba, Ibaraki (JP); Hiroju Takanezawa, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 343 days.

(21) Appl. No.: 13/369,522

(22) Filed: Feb. 9, 2012

(65) Prior Publication Data

US 2012/0207495 A1 Aug. 16, 2012

(30) Foreign Application Priority Data

Feb. 14, 2011 (JP) ..... 2011-028962
Nov. 30, 2011 (JP) ..... 2011-261858

(51) Int. Cl.
*G03G 15/20* (2006.01)

(52) U.S. Cl.
CPC ..... *G03G 15/2078* (2013.01); *G03G 15/2064* (2013.01)
USPC ..... 399/67; 399/337

(58) Field of Classification Search
CPC ..... G03G 15/2078; G03G 15/2064
USPC ..... 399/67, 69, 329, 337
See application file for complete search history.

(56) References Cited

U.S. PATENT DOCUMENTS 6,181,890 B1 * 1/2001 Kataoka et al. ..... 399/67
2009/0317100 A1 * 12/2009 Shimizu ..... 399/33
2011/0311249 A1 * 12/2011 Kubota et al. ..... 399/44

FOREIGN PATENT DOCUMENTS

JP 2008-139724 6/2008
JP 2005142023 8/2008
JP 2006178012 1/2011

* cited by examiner

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

In an embodiment, a fixing device includes: a fixing member that revolves in a circumferential direction in a heated state and transfers heat to a recording medium that is brought into contact with an outer circumferential face thereof; a temperature detecting unit that detects a temperature of the outer circumferential face of the fixing member; and a circumferential-direction position adjusting unit that adjusts a circumferential-direction position of the fixing member such that the recording medium is brought into contact with a high temperature portion out of the high-temperature portion of the outer circumferential face of the fixing member of which temperature detected by the temperature detecting unit is relatively high and a low-temperature portion of which temperature detected by the temperature detecting unit is relatively low.

10 Claims, 4 Drawing Sheets

FIXING DEVICE, IMAGE FORMING APPARATUS, AND METHOD OF CONTROLLING FIXING DEVICE

CROSS-REFERENCE TO RELATED APPLICATIONS

The present application claims priority to and incorporates by reference the entire contents of Japanese Patent Application No. 2011-028962 filed in Japan on Feb. 14, 2011 and Japanese Patent Application No. 2011-261858 filed in Japan on Nov. 30, 2011.

BACKGROUND OF THE INVENTION

1. Field of the Invention

The present invention relates to a fixing device, an image forming apparatus, and a method of controlling a fixing device.

2. Description of the Related Art

An image forming apparatus employing electrophotography includes a fixing device that fixes a toner image transferred onto a recording medium by heating and pressing the toner image. The fixing device includes a fixing member that revolves in the circumferential direction in a heated state and that applies heat to a recording medium that is brought into contact with its outer circumferential face and a pressing member that brings the recording medium into contact with the outer circumferential face of the fixing member in a pressing manner. The fixing device conveys and interposes the recording medium between the fixing member and the pressing member to heat and press the toner image, thereby fixing the toner image positioned on the recording medium.

The fixing devices are categorized into fixing devices of a roller fixing-type and fixing devices of a belt fixing-type. In the roller fixing-type of fixing device, a fixing roller that includes an internal heat source such as a heater is used as the fixing member. In the belt fixing-type of fixing device, an endless fixing belt that revolves in a state heated by an external heat source is used as the fixing member. In either the roller fixing-type or the belt fixing-type of fixing device, a temperature detecting unit is arranged near the heat source or the fixing member, and the temperature of the heat source is controlled in accordance with the temperature detected by the temperature detecting unit.

However, in conventional fixing devices, it is difficult to maintain the temperature of the outer circumferential face of the fixing member to be uniform in the circumferential direction. Therefore, the fixing is sometimes unstable due to the temperature unevenness. Factors causing the temperature unevenness on the outer circumferential face of the fixing member include a difference in distance from a heat source depending on position in the circumferential direction of the outer circumferential face of the fixing member, the occurrence of a local temperature drop due to transfer of heat from the fixing member to a recording medium that is brought into contact with the outer circumferential face of the fixing member, and the like.

When temperature unevenness occurs on the outer circumferential face of the fixing member, the amount of heat applied to toner located on the recording medium changes in accordance with a position in the circumferential direction of the fixing member, and accordingly, a fixing defect is likely to occur. In order to solve such a problem, there is a known method which controls the temperature of a heat source so as to suppress the occurrence of temperature unevenness on the outer circumferential face of the fixing member.

For example, Japanese Patent No. 4170197 discloses a technology in which a fixing member is preheated by operating an internal heat source disposed inside a pressing member in a printing stand-by state, and in returning mode for returning to a printing operation from the printing standby state, a non-heated area at which the temperature of the outer circumferential face of the fixing member is low is moved to a position where heating by a local heat source is performed, the non-heated area is made to stay there for a predetermined time, and power higher than that supplied at the time of a printing operation is input to the local heat source so as to raise the temperature.

However, according to the technology disclosed in Japanese Patent No. 4170197 or many other conventional technologies, the temperature of the heat source is adjusted before performing a printing operation, and the printing operation is started at timing when there is no temperature unevenness. Accordingly, it is difficult to suppress the occurrence of temperature unevenness in the middle of a printing operation. For example, when recording media that are sequentially supplied to the fixing device at the time of consecutive printing operations are repeatedly brought into contact with the same place on the outer circumferential face of the fixing member, a temperature difference between a portion of the fixing member brought into contact with the recording media and a portion of the fixing member that is not brought into contact with the recording media increases, so that temperature unevenness occurs. However, according to the conventional technology in which the temperature of the heat source is adjusted before performing a printing operation, it is difficult to suppress the occurrence of the temperature unevenness in the middle of a printing operation.

In addition, even in a case where temperature unevenness occurring in the middle of a printing operation is tried to be resolved through the adjustment of the temperature of the heat source in the middle of the printing operation, there is a case where the temperature difference between a high-temperature portion of the outer circumferential face of the fixing member and a low-temperature portion thereof may further increase through adjustment of the temperature of the heat source, so that it is difficult to solve the temperature unevenness.

SUMMARY OF THE INVENTION

It is an object of the present invention to at least partially solve the problems in the conventional technology.

According to an embodiment, a fixing device included: a fixing member that revolves in a circumferential direction in a heated state and transfers heat to a recording medium that is brought into contact with an outer circumferential face thereof; a temperature detecting unit that detects a temperature of the outer circumferential face of the fixing member; and a circumferential-direction position adjusting unit that adjusts a circumferential-direction position of the fixing member such that the recording medium is brought into contact with a high temperature portion out of the high-temperature portion of the outer circumferential face of the fixing member of which temperature detected by the temperature detecting unit is relatively high and a low-temperature portion of which temperature detected by the temperature detecting unit is relatively low.

According to another embodiment, an image forming apparatus includes: the fixing device mentioned above.

According to still another embodiment, a method of controlling a fixing device including a fixing member that revolves in a circumferential direction in a heated state and transfers heat to a recording medium that is brought into contact with an outer circumferential face, the method including: detecting a temperature of the outer circumferential face of the fixing member by using a temperature detecting unit; and adjusting a circumferential-direction position of the fixing member such that the recording medium is brought into contact with a high temperature portion out of the high-temperature portion of the outer circumferential face of the fixing member of which temperature detected by the temperature detecting unit is relatively high and a low-temperature portion of which temperature detected by the temperature detecting unit is relatively low, by using a circumferential-direction position adjusting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a fixing device, an image forming apparatus, and a method of controlling a fixing device according to embodiments will be described in detail with reference to the accompanying drawings. Although the embodiments described below are examples in which the invention is applied to a belt fixing-type fixing device, the embodiment can be effectively applied to a roller fixing-type fixing device as well. In a case where the embodiment is applied to the roller fixing-type fixing device, a fixing belt described in the embodiments presented below may be replaced by a fixing roller.

Figure 1:
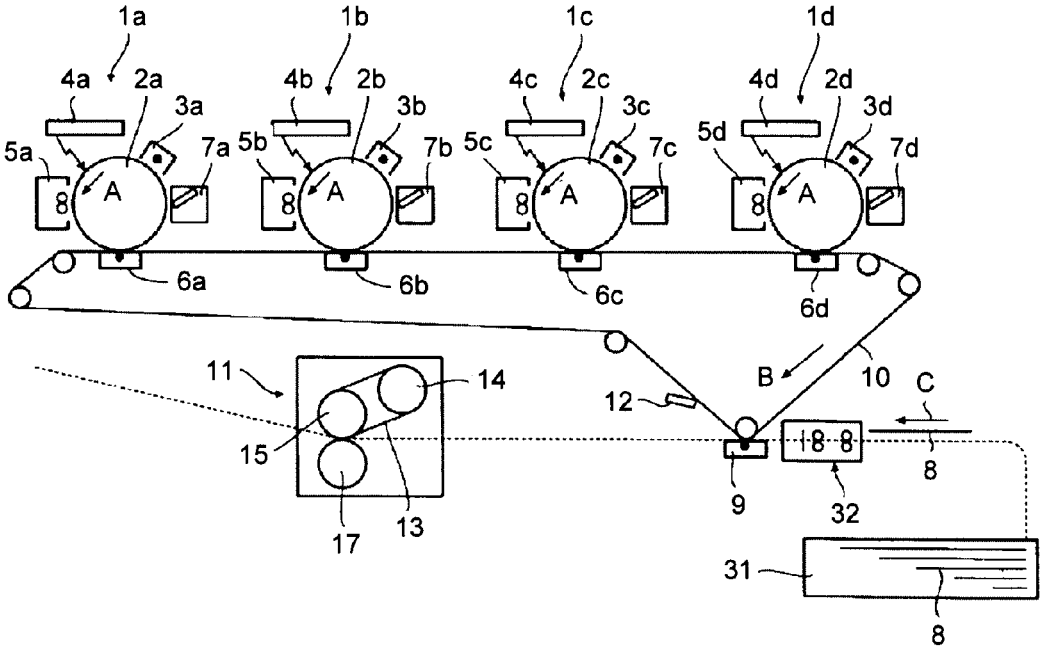
FIG. 1 is a schematic configuration diagram of an image forming apparatus according to an embodiment.

FIG. 1 is a schematic configuration diagram of an image forming apparatus according to this embodiment. The image forming apparatus illustrated in FIG. 1 is an image forming apparatus configured to form a full-color image of four colors through electrophotography. The image forming apparatus, as illustrated in FIG. 1, includes four image forming units 1*a*, 1*b*, 1*c*, and 1*d* arranged in the traveling direction (the direction of arrow B in the figure) of a transfer belt 10.

The image forming unit 1*a* includes a photosensitive element 2*a*, a drum charging device 3*a*, an exposure device 4*a*, a developing unit 5*a*, a transfer device 6*a*, and a cleaning device 7*a*. The drum charging device 3*a*, the exposure device 4*a*, the developing unit 5*a*, the transfer device 6*a*, and the cleaning device 7*a* are arranged along the rotation direction (the direction of arrow A in the figure) of the photosensitive element 2*a*.

The image forming units 1*b* to 1*d*, similarly to the image forming unit 1*a*, include photosensitive elements 2*b* to 2*d*, drum charging devices 3*b* to 3*d*, exposure devices 4*b* to 4*d*, developing units 5*b* to 5*d*, transfer devices 6*b* to 6*d*, and cleaning devices 7*b* to 7*d*. The image forming units 1*a* to 1*d* form images of different colors. For example, the image forming unit 1*a* forms a yellow image, the image forming unit 1*b* forms a magenta image, the image forming unit 1*c* forms a cyan image, and the image forming unit 1*d* forms a black image.

When an instruction signal for starting an image forming operation is received from a control device not illustrated in the figure, the photosensitive element 2*a* starts to rotate in the direction of arrow A in the figure and continues to rotate until the image forming operation is completed. When the photosensitive element 2*a* starts to rotate, a high voltage is applied to the drum charging device 3*a*, and negative electric charge is uniformly distributed on the surface of the photosensitive element 2*a*.

Thereafter, a laser beam controlled to be turned on/off in accordance with image data is emitted from the exposure device 4*a* to the surface of the photosensitive element 2*a* that is uniformly charged. Accordingly, on the surface of the photosensitive element 2*a*, a portion to which the laser beam has been emitted and a portion to which any laser beam has not emitted are formed.

Then, when a portion of the surface of the photosensitive element 2*a* in which electric charge decreases through the emission of the laser beam from the exposure device 4*a* arrives at a position facing the developing unit 5*a* in accordance with the rotation of the photosensitive element 2*a*, toner charged with negative electric charge is attracted to the portion of the surface of the photosensitive element 2*a* in which the electric charge decrease. Accordingly, a toner image corresponding to image data is formed on the photosensitive element 2*a*.

When the toner image formed on the photosensitive element 2*a* arrives at a position facing the transfer device 6*a* through the transfer belt 10, the toner image is attracted to the transfer belt 10 side in accordance with an action of a high voltage applied to the transfer device 6*a* so as to be transferred onto the transfer belt 10 traveling in the direction of arrow B in the figure. In addition, toner that has not been transferred to the transfer belt 10 and remains on the photosensitive element 2*a* is cleaned by the cleaning device 7*a*.

Also in the image forming unit 1*b* following the image forming unit 1*a*, an image forming operation is similarly performed, and a toner image formed on the photosensitive element 2*b* is transferred onto the transfer belt 10 in accordance with an action of a high voltage applied to the transfer device 6*b*. At this time, by matching timing at which an image that is formed by the image forming unit 1*a* and is transferred onto the transfer belt 10 arrives at the position facing the transfer device 6*b* and timing at which the toner image formed on the photosensitive element 2*b* arrives at a position facing the transfer device 6*b* through the transfer belt 10, the toner image formed by the image forming unit 1*a* and the toner image formed by the image forming unit 1*b* overlap each other on the transfer belt 10.

Similarly, a toner image formed on the photosensitive element 2*c* of the image forming unit 1*c* and a toner image formed on the photosensitive element 2*d* of the image forming unit 1*d* are transferred onto the transfer belt 10 so as to be sequentially superimposed. Accordingly, a full-color toner image of four colors is formed on the transfer belt 10.

Meanwhile a recording medium 8 as a cut sheet fed from a paper feeding unit 31 is conveyed in the direction of arrow C illustrated in the figure and arrives at a registration unit 32. Then, the recording medium 8 is conveyed from the registration unit 32 to a position facing a paper transfer device 9 at timing at which the full-color toner image arrives at a position facing the paper transfer device 9 in accordance with the traveling of the transfer belt 10. At this time, the full-color toner image formed on the transfer belt 10 is transferred onto the recording medium 8 in accordance with the action of a high voltage applied to the paper transfer device 9. In addition, toner remaining on the transfer belt 10 without being transferred onto the recording medium 8 is cleaned by a belt cleaning mechanism 12.

The recording medium 8, onto which the full-color toner image has been transferred, is supplied to a fixing device 11. Then, the toner image formed on the recording medium 8 is heated and pressed by the fixing device 11, whereby the full-color toner image is fixed to the recording medium 8.

Figure 2:
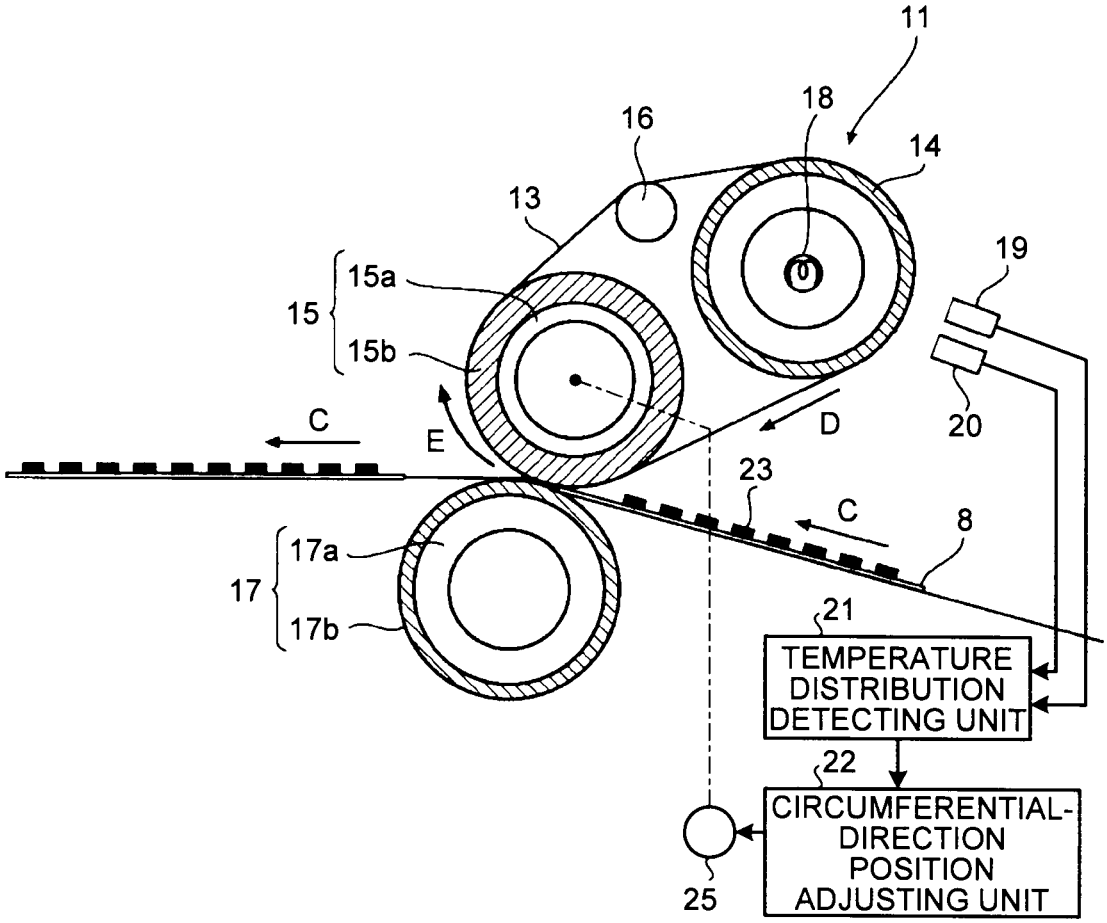
FIG. 2 is a schematic configuration diagram of a fixing device according to an embodiment.

FIG. 2 is a schematic configuration diagram of the fixing device 11. The fixing device 11 is a belt-fixing-type fixing device using a fixing belt 13 as a fixing member. The fixing device 11 includes the fixing belt 13, a heating roller 14, a fixing roller 15, a tension roller 16, and a pressing roller 17.

The fixing belt 13 is an endless belt having a multi-layer structure in which an elastic layer and a mold release layer are sequentially stacked on a base layer made of a resin material.

The elastic layer of the fixing belt 13 is formed from an elastic material such as fluorine-contained rubber, silicon rubber, or foaming silicon rubber. The mold release layer of the fixing belt 13 is formed by using perfluoroalkoxy tetrafluoroethylene copolymer resin (PFA), polyimide, polyetherimide, polyether sulfide (PES) or the like. By arranging the mold release layer on the surface layer of the fixing belt 13, mold releasability (detachability) for a toner image 23 is secured.

The fixing belt 13 is stretched over and supported by three roller members (the heating roller 14, the fixing roller 15, and the tension roller 16). The tension roller 16 serves to apply predetermined tension to the fixing belt 13 stretched over the three roller members.

The heating roller 14 is a roller member configured by a thin-walled cylinder formed from a metal material. The heating roller 14 has shaft bearings, which are installed to the side plates of the fixing device 11 so as to be rotatable through shaft bearings, on both ends thereof. Inside the heating roller 14, a heater 18 (heating source) configured by a halogen heater or a carbon heater is disposed so as to be fixed. Both end portions of the heater 18 are fixed to the side plates of the fixing device 11. The heater 18 disposed inside the heating roller 14 is supplied with power from a power supply unit (AC power supply), not illustrated in the figure, and generates heat. The heating roller 14 is heated by radiant heat supplied from the heater 18, and heat is given to the toner image 23 formed on the recording medium 8 from the outer circumferential face of the fixing belt 13 that is heated by the heating roller 14.

The output of the heater 18 is controlled based on the temperature of the outer circumferential face of the fixing belt 13 that is detected by a temperature detecting unit 19. For example, power supplied to the heater 18 from the power supply unit is controlled such that the temperature of the outer circumferential face of the fixing belt 13, which is detected by the temperature detecting unit 19, is close to set fixing temperature to be described later.

The fixing roller 15 is a roller member acquired by forming an elastic layer 15*b* formed from fluorine-contained rubber, silicon rubber, foaming silicon rubber, or the like on a core metal 15*a* that is formed from stainless steel (for example SUS304) or the like. The fixing roller 15 has shaft bearing, which are installed to the side plates of the fixing device 11 through shaft bearings so as to be rotatable, on both ends thereof. The fixing roller 15 is driven to rotate in the clockwise direction (the direction of arrow E in the figure) by a motor 25. The fixing belt 13 revolves in the direction of arrow D illustrated in the figure in accordance with the rotation of the fixing roller 15.

The pressing roller 17 has approximately the same configuration as that of the fixing roller 15 and is a roller member acquired by forming an elastic layer 17*b* made of fluorine-contained rubber, silicon rubber, foaming silicon rubber, or the like on a core metal 17*a* that is formed from stainless steel (for example SUS304) or the like.

In the fixing device 11, the pressing roller 17 is brought into tight contact with the fixing roller 15 through the fixing belt 13, a recording medium 8 is conveyed while being interposed between the fixing belt 13 and the pressing roller 17. At this time, by applying heat and pressure to the toner image 23 formed on the recording medium 8, the toner image 23 formed on the recording medium 8 is fixed to the recording medium 8.

When the recording medium 8 supplied to the fixing device 11 is brought into contact with the outer circumferential face of the fixing belt 13, heat is absorbed by the recording medium 8 from a position of the outer circumferential face of the fixing belt 13 that is brought into contact with the recording medium 8; and the outer circumferential face partly decreases in temperature. In a case where the recording media 8 are consecutively supplied to the fixing device 11, a temperature drop at the position of the outer circumferential face of the fixing belt 13, which is brought into contact with the recording medium 8, is large so as to be a factor causing the occurrence of temperature unevenness on the outer circumferential face of the fixing belt 13.

Particularly, in a case where the conveying period of the recording media 8 that are sequentially supplied to the fixing device 11 and the revolving period of the fixing belt 13 match each other, the recording media 8 are repeatedly brought into contact with the same position located on the outer circumferential face of the fixing belt 13, the temperature drop at the position located on the outer circumferential face of the fixing belt 13, which is brought into contact with the recording media 8, is largest.

When temperature unevenness occurs on the outer circumferential face of the fixing belt 13, the amount of heat given to the toner image 23 formed on the recording medium 8 changes in accordance with the position of the fixing belt 13 in the circumferential direction, whereby a fixing defect may occur. Thus, the fixing device 11 according to this embodiment detects the temperature distribution of the outer circumferential face of the fixing belt 13 and adjusts the position of the fixing belt 13 in the circumferential direction such that the recording medium 8 is brought into contact with a high-temperature portion in a printing operation in which the fixing belt 13 revolves, thereby suppressing an extreme temperature difference on the outer circumferential face of the fixing belt 13 so as to suppress the occurrence of temperature unevenness in the middle of the printing operation.

The fixing device 11 according to this embodiment includes a temperature detecting unit 19, a position detecting unit 20, a temperature distribution detecting unit 21, and a circumferential-direction position adjusting unit 22 as a configuration realizing a control process for suppressing the occurrence of temperature unevenness in the middle of a printing operation. Here, for example, in a case where the fixing device 11 includes a microcomputer that includes a CPU, a ROM, a RAM, an input/output circuit, and the like, the temperature distribution detecting unit 21 and the circumferential-direction position adjusting unit 22 may be realized by a program (software) executed by the microcomputer. In addition, the temperature distribution detecting unit 21 and the circumferential-direction position adjusting unit 22 may be configured by using dedicated hardware such as an application specific integrated circuit (ASIC), or an field-programmable gate array (FPGA).

The temperature detecting unit 19, for example, is configured by a thermopile disposed near the surface of the fixing belt 13 and detects the temperature of the surface of the fixing belt 13. The detected temperature that is detected by the temperature detecting unit 19, as described above, is used for controlling the output of the heater 18. In this embodiment, the detected temperature that is detected by the temperature detecting unit 19 is input to the temperature distribution detecting unit 21 as well.

The position detecting unit 20, for example, is configured by an optical sensor disposed near the temperature detecting unit 19 and the like, and is used for detecting the position of the outer circumferential face of the fixing belt 13 of which the temperature has been detected by the temperature detecting unit 19.

Figure 3A:
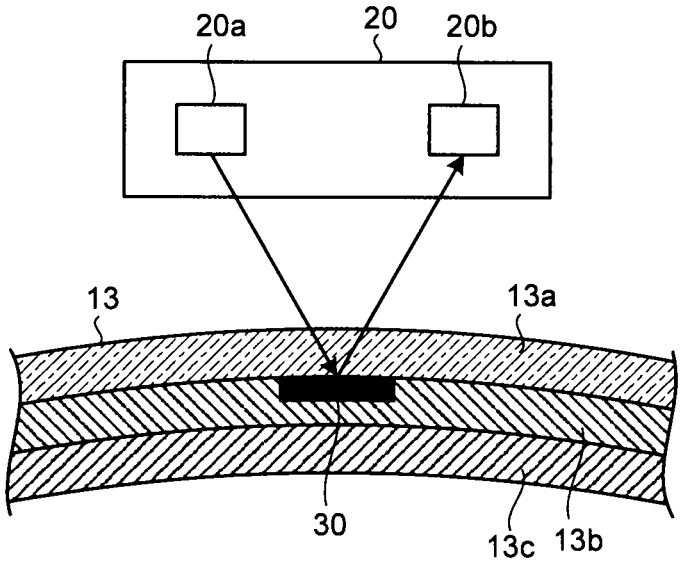
FIGS. 3A and 3B are diagrams illustrating an example of a position detecting unit.
Figure 3B:
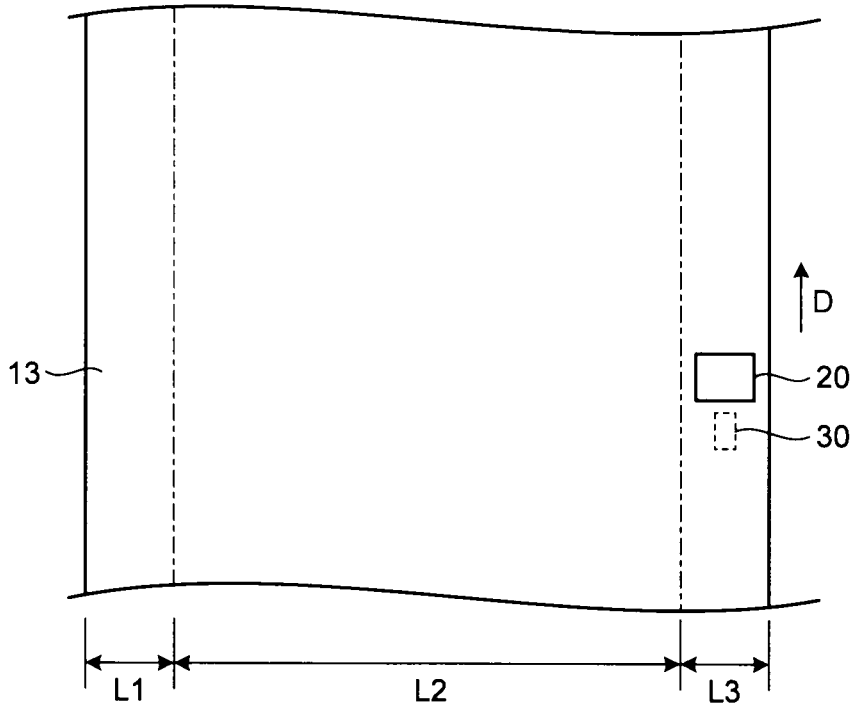

FIGS. 3A and 3B are diagrams illustrating an example of the position detecting unit 20. FIG. 3A illustrates the appearance of the position detecting unit 20 and the fixing belt 13 viewed along the outer circumferential face of the fixing belt 13; and FIG. 3B illustrates the appearance of the position detecting unit 20 and the fixing belt 13 viewed in a direction perpendicular to the outer circumferential face of the fixing belt 13.

The position detecting unit 20, as illustrated in FIG. 3A, is a reflection-type optical sensor, for example, including one pair of a light emitting unit 20*a* and a light receiving unit 20*b*. In order to detect the position of the surface of the fixing belt 13 by using the position detecting unit 20 that is configured by the reflection-type optical sensor, a marking member 30, for example, formed from an aluminum foil or the like is buried in the fixing belt 13.

The fixing belt 13, as described above, has a multi-layer structure in which an elastic layer 13*b* and an mold release layer 13*a* are sequentially stacked on an base layer 13*c*. The marking member 30, as illustrated in FIG. 3A, is buried between the elastic layer 13*b* and the mold release layer 13*a* of the fixing belt 13. In addition, in the fixing belt 13, as illustrated in FIG. 3B, blank areas L1 and L3 that are not brought into contact with the recording medium 8 are arranged on both end portions in a direction perpendicular to the revolving direction denoted by arrow D in the figure within the outer circumferential face. The marking member 30 is buried in one (for example, the blank area L3) of the blank areas L1 and L3 of the fixing belt 13. The area L2 illustrated in the figure illustrates an area of the outer circumferential face of the fixing belt 13 that is brought into contact with the recording medium 8.

When the position at which the marking member 30 is buried arrives at a position facing the position detecting unit 20 in accordance with the revolving of the fixing belt 13, the position detecting unit 20 detects the marking member 30. The position of the outer circumferential face of the fixing belt 13 at which the temperature is detected by the temperature detecting unit 19 can be specified based on a time difference between the timing when the marking member 30 is detected by the position detecting unit 20 and the timing when the temperature is detected by the temperature detecting unit 19, and the revolving speed of the fixing belt 13.

Although an example has been described in which the optical sensor is used as the position detecting unit 20, for example, a magnetic sensor or the like other than the optical sensor may be used as the position detecting unit 20. In such a case, by configuring the marking member 30 using a magnetic material, the position detecting unit 20 detects the marking member 30 when the position of the fixing belt 13 at which the marking member 30 is buried arrives at the position facing the position detecting unit 20. In a case where a magnetic sensor is used as the position detecting unit 20, the marking member 30 can be buried in an area L2 of the fixing belt 13 that is brought into contact with the recording medium 8, and the blank areas L1 and L3 may not be necessary. However, since the magnetic sensor can be more easily affected by heat than the optical sensor, in a case where the magnetic sensor is used as the position detecting unit 20, a sufficient heat resisting countermeasure needs to be performed for the position detecting unit 20.

The temperature distribution detecting unit 21 detects the temperature distribution of the outer circumferential face of the fixing belt 13 based on the detected temperature that is detected by the temperature detecting unit 19 and the output of the position detecting unit 20.

The temperature of the outer circumferential face of the fixing belt 13, as described above, is controlled so as to be the set fixing temperature through output control of the heater 18. The set fixing temperature is a temperature that is set in advance in accordance with the attributes (a paper type, a size, a thickness, and the like) of a recording medium 8 to be used. However, the heat of a portion of the outer circumferential face of the fixing belt 13 that is brought into contact with the recording medium 8 is absorbed by the recording medium 8, and the temperature of the portion is lower than the set fixing temperature. On the other hand, the temperature of a portion of the outer circumferential face of the fixing belt 13 that is not brought into contact with the recording medium 8 is maintained to be close to the set fixing temperature. Accordingly, a temperature distribution is generated on the outer circumferential face of the fixing belt 13 in which portions having relatively high temperature and portions having relatively low temperature are included. The temperature distribution detecting unit 21 detects the temperature distribution of the outer circumferential face of the fixing belt 13. The above-described temperature unevenness represents a state in which a temperature difference between the high-temperature portion and the low-temperature portion is extremely large in the temperature distribution.

Hereinafter, the portion of the circumferential face of the fixing belt 13 that has relatively low temperature is referred to as a low-temperature portion, and the portion of the circumferential face of the fixing belt 13 that has relatively high temperature is referred to as a high-temperature portion. The high-temperature portion is a portion of which the temperature is maintained to be close to the set fixing temperature. In addition, the temperature of the low-temperature portion that is detected by the temperature detecting unit 19 will be referred to as a low-temperature portion detecting temperature.

The circumferential-direction position adjusting unit 22 adjusts the circumferential-direction position of the fixing belt 13 such that the recording medium 8 is brought into contact with the high-temperature portion based on the temperature distribution of the outer circumferential face of the fixing belt 13 that is detected by the temperature distribution detecting unit 21. For example, the circumferential-direction position adjusting unit 22 calculates a temperature difference $\Delta T$ (=T1−T2) between the set fixing temperature T1 and the low-temperature portion detecting temperature T2, and adjusts the circumferential-direction position of the fixing belt 13 such that the recording medium 8 is brought into contact with the high-temperature portion of the outer circumferential face of the fixing belt 13 when the temperature difference ΔT exceeds a threshold value Tth set in advance. Accordingly, the temperature difference between the high-temperature portion and the low-temperature portion of the outer circumferential face of the fixing belt 13 can be alleviated, and the occurrence of temperature unevenness in the middle of a printing operation can be effectively suppressed.

The adjustment of the circumferential-direction position of the fixing belt 13 by using the circumferential-direction position adjusting unit 22, for example, can be realized by recognizing the timing when the recording medium 8 is brought into contact with the outer circumferential face of the fixing belt 13 and controlling the operation of the fixing belt 13 such that the high-temperature portion of the outer circumferential face of the fixing belt 13 arrives at a position that is brought into contact with the recording medium 8 in accordance with the timing, based on the size of the used recording medium 8 and the conveying period of the recording medium 8 that is set in accordance with the printing speed.

Described in detail, for example, in a case where a variable-speed motor is used as the motor 25 that rotates the fixing belt 13 by driving the fixing roller 15 to rotate, the circumferential-direction position adjusting unit 22 adjusts the circumferential-direction position of the fixing belt 13 by changing the speed of the variable-speed motor 25. In such a case, the changing of the speed of the motor 25 is performed during a period between recording media 8 that are consecutively supplied to the fixing device 11. In other words, after a recording medium 8 supplied in advance to the fixing device 11 is discharged from the fixing device 11, the speed of the motor 25 is changed so as to adjust the circumferential-direction position of the fixing belt 13 until the following recording medium 8 is supplied to the fixing device 11.

The fixing belt 13 revolves during a printing operation, and accordingly, in a case where one temperature detecting unit 19 is disposed in the circumferential direction of the fixing belt 13 as illustrated in FIG. 2, the temperature of the outer circumferential face of the fixing belt 13 can be detected by the temperature detecting unit 19 over the entire circumference. On the other hand, in a case where a plurality of the temperature detecting units 19 are disposed along the circumferential direction of the fixing belt 13, and the temperature detecting area of the circumferential face of the fixing belt 13 in the circumferential direction is shared by the plurality of the temperature detecting units 19, a time required for detecting the temperature of the outer circumferential face over the entire circumference of the fixing belt 13, that is, a time required for detecting the temperature distribution of the outer circumferential face of the fixing belt 13 can be shortened.

For example, as illustrated in FIG. 2, in a case where the temperature detecting unit 19 is disposed only at a position near the heating roller 14, the fixing belt 13 needs to revolve once until the temperature of the outer circumferential face is detected over the entire circumference of the fixing belt 13. In other words, a time corresponding to one cycle of the fixing belt 13 is necessary until the temperature distribution of the outer circumferential face of the fixing belt 13 is detected. Here, in a case where the temperature detecting unit 19 is additionally disposed at a position near the fixing roller 15 in addition to the position near the heating roller 14, and two temperature detecting units 19 share the temperature detecting area of the outer circumferential face of the fixing belt 13, the fixing belt 13 may be allowed to revolve for a half cycle until the temperature of the outer face is detected over the entire circumference of the fixing belt 13. Thus, in such a case, the time required for detecting the temperature distribution of the outer circumferential face of the fixing belt 13 can be decreased by half. Accordingly, the responsiveness of the circumferential-direction position adjusting unit 22 is improved, and the temperature difference between the high-temperature portion and the low-temperature portion of the outer circumferential face of the fixing belt 13 can be alleviated in a speedy manner, whereby the occurrence of temperature unevenness can be suppressed more effectively.

As described above, in a case where the conveying period of the recording media 8 sequentially supplied to the fixing device 11 and the revolving period of the fixing belt 13 match each other, the recording media 8 are repeatedly brought into contact with the same position located on the outer circumferential face of the fixing belt 13, and accordingly, a temperature drop in the low-temperature portion increases. Thus, in a case where the conveying period of the recording medium 8 that is set in accordance with the size of the used recording medium 8 and the printing speed matches the revolving period of the fixing belt 13, it is preferable that a threshold value Tth as a reference used for determining whether or not the circumferential-direction position of the fixing belt 13 is adjusted by the circumferential-direction position adjusting unit 22 is set to a value less than a specified value set in a case where the conveying period of the recording medium 8 and the revolving period of the fixing belt 13 do not match each other. In such a case, before the temperature of the low-temperature portion of the outer circumferential face of the fixing belt 13 decreases to a large extent, the circumferential-direction position of the fixing belt 13 is adjusted by the circumferential-direction position adjusting unit 22 so as to alleviate the temperature difference between the high-temperature portion and the low-temperature portion in a speedy manner, whereby the occurrence of temperature unevenness on the outer circumferential face of the fixing belt 13 can be suppressed more effectively. The "matching" described here is not necessarily limited to complete matching, and some error may be included therein.

In addition, the amount of heat absorbed from the outer circumferential face of the fixing belt 13 due to a contact with the recording medium 8 differs in accordance with the thickness of the recording medium 8; and, in a case where the thickness of the recording medium 8 is large, the amount of heat larger than that of a case where the thickness of the recording medium 8 is small is absorbed; and accordingly, the temperature in the low-temperature portion drops by a lot. Thus, in a case where the used recording medium 8 is a cardboard having a paper thickness larger than a predetermined value, it is preferable to set the threshold value Tth to a value less than the specified value set in a case where the used recording medium 8 is thin paper having a paper thickness of a predetermined value or less. As a specific example, for example, in a case where a predetermined value of a paper thickness that is a reference used for determining a cardboard or thin paper is 70 g/m$^2$, and the predetermined value of the threshold value Tth set in a case where the used recording medium 8 is thin paper is 2° C., the threshold value Tth is set to 1° C. in a case where the used recording medium 8 is a card board having a paper thickness of 135 g/m$^2$. Accordingly, before the temperature of the low-temperature portion of the outer circumferential face of the fixing belt 13 drops to a large extent, the circumferential-direction position of the fixing belt 13 is adjusted by the circumferential-direction position adjusting unit 22, and the temperature difference between the high-temperature portion and the low-temperature portion can be alleviated in a speedy manner, whereby the occurrence of temperature unevenness on the outer circumferential face of the fixing belt 13 can be suppressed more effectively.

In addition, in a case where the length of the fixing belt 13 in the circumferential direction is shorter than the length of the used recording medium 8 in the conveying direction, the fixing belt 13 revolves one or more cycles while one recording medium 8 is conveyed. At this time, the recording medium 8 supplied to the fixing device 11 is brought into contact with a part of the outer circumferential face of the fixing belt 13 twice. In other words, the leading edge portion and the trailing edge portion of one recording medium 8 in the conveying direction are consecutively brought into contact with the same position located on the outer circumferential surface of the fixing belt 13.

In such a case, the temperature of the portion of the outer circumferential face of the fixing belt 13 that is brought into contact with the recording medium 8 twice drops more than the portion that is brought into contact with the recording medium 8 once; and the portion brought into contact with the recording medium 8 twice is a low-temperature portion; and the portion brought into contact with the recording medium 8 only once is a high-temperature portion. In a case where the recording medium 8 sequentially supplied by the fixing device 11 is repeatedly brought into contact with the same position located on the outer circumferential face of the fixing belt 13 twice, the temperature difference between the high-temperature portion and the low-temperature portion is large so as to cause the occurrence of temperature unevenness.

Thus, in a case where the recording media 8 are sequentially supplied to the fixing device 11, the length of the fixing belt 13 in the circumferential direction is shorter than the length of the recording medium 8 in the conveying direction, and one recording medium 8 is brought into contact twice with a part of the outer circumferential face of the fixing belt 13, it is preferable that the circumferential-direction position of the fixing belt 13 is adjusted by the circumferential-direction position adjusting unit 22 such that the next recording medium 8 is not brought into contact twice with the portion of the outer circumferential face of the fixing belt 13 that has been brought into contact twice with the recording medium 8 supplied in advance to the fixing device 11. In such a case, even in a case where one recording medium 8 is brought into contact twice with a part of the outer circumferential face of the fixing belt 13, the temperature difference between the high-temperature portion and the low-temperature portion is suppressed, whereby the occurrence of temperature unevenness on the outer circumferential face of the fixing belt 13 can be effectively suppressed.

Figure 4:
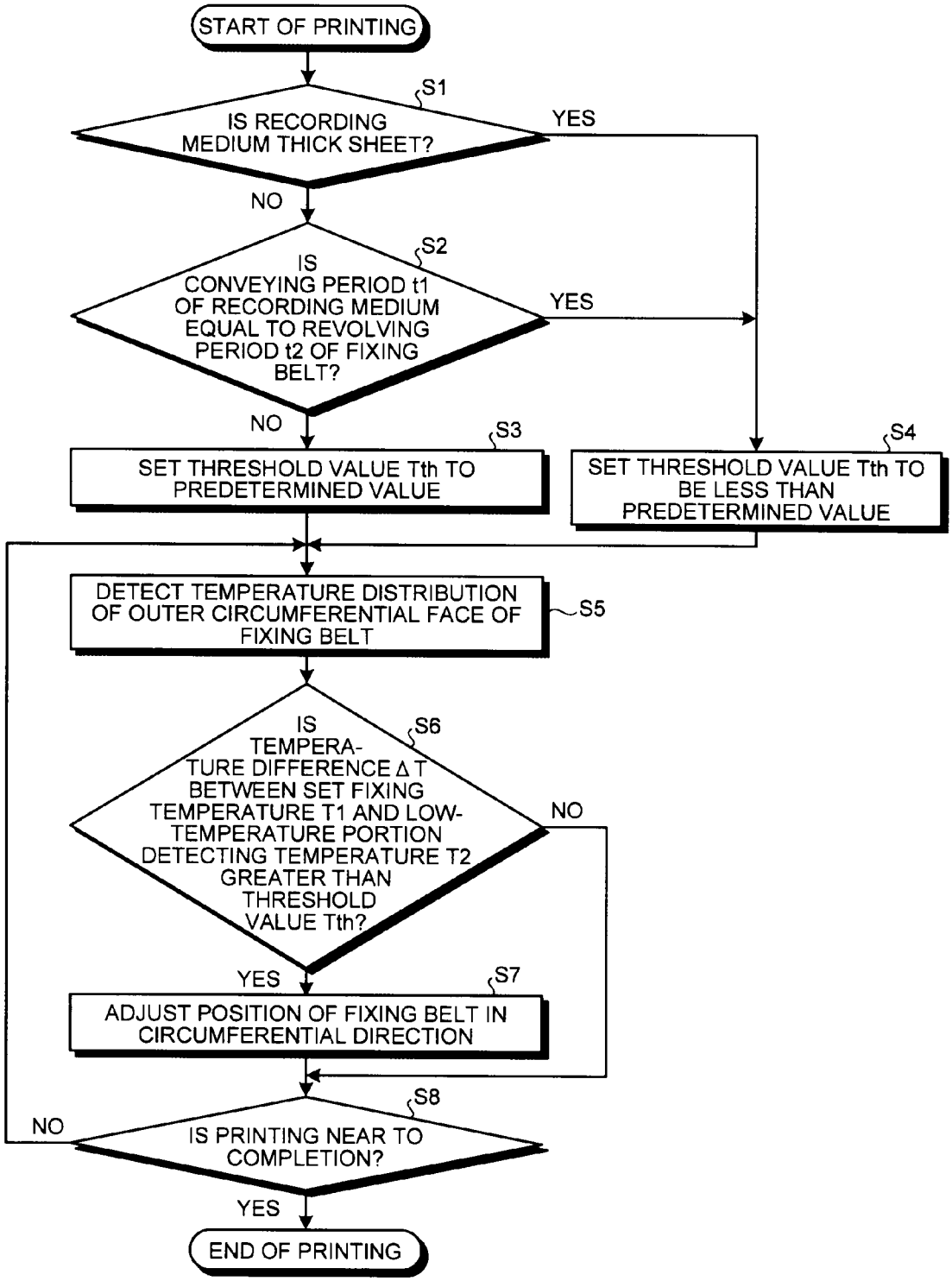
FIG. 4 is a flowchart illustrating a control process for suppressing the occurrence of temperature unevenness in the middle of a printing operation.

FIG. 4 is a flowchart illustrating a control process for suppressing the occurrence of temperature unevenness in the middle of a printing operation. Hereinafter, specific steps included in the control process for suppressing the occurrence of temperature unevenness in the middle of a printing operation will be described with reference to the flowchart illustrated in FIG. 4.

Step S1: It is determined whether or not the recording medium 8 used for printing is a cardboard. For example, in a case where the paper thickness of the recording medium 8 used for printing is 70 g/m$^2$ or less, the recording medium is determined not to be a cardboard (No in Step S1), and the process proceeds to Step S2. On the other hand, in a case where the paper thickness of the recording medium 8 used for printing is larger than 70 g/m$^2$, the recording medium is determined to be a cardboard (Yes in Step S1), the process proceeds to Step S4.

Step S2: It is determined whether or not the conveying period t1 set in accordance with the size of the recording medium 8 and the printing speed matches the revolving period t2 of the fixing belt 13. In a case where the conveying period t1 of the recording medium 8 does not match the revolving period t2 of the fixing belt 13 (No in Step S2), the process proceeds to Step S3. On the other hand, in a case where the conveying period t1 of the recording medium 8 matches the revolving period t2 of the fixing belt 13 (Yes in Step S2), the process proceeds to Step S4.

Step S3: A threshold value Tth for the temperature difference ΔT between the set fixing temperature T1 and the low-temperature portion detecting temperature T2 is set to a predetermined value (a commonly set value, for example 2° C.), and the process proceeds to Step S5.

Step S4: The threshold value Tth for the temperature difference ΔT between the set fixing temperature T1 and the low-temperature portion detecting temperature T2 is set to a value less than the predetermined value (for example 1° C.), and the process proceeds to Step S5.

Step S5: The temperature distribution of the outer circumferential face of the fixing belt 13 is detected base on the detected temperature detected by the temperature detecting unit 19 and the output of the position detecting unit 20, and the process proceeds to Step S6.

Step S6: It is determined whether or not a temperature difference ΔT between the set fixing temperature T1 that is set in accordance with the attributes of the recording medium 8 used for printing and the temperature (low-temperature portion detecting temperature) T2 of the low-temperature portion in the temperature distribution detected in Step S5 exceeds the threshold value Tth set in Step S3 or Step S4. In a case where the temperature difference ΔT exceeds the threshold value Tth (Yes in Step S6), the process proceeds to Step S7. On the other hand, in a case where the temperature difference ΔT is the threshold value Tth or less (No in Step S6), the process proceeds to Step S8.

Step S7: The position of the fixing belt 13 in the circumferential direction is adjusted such that the recording medium 8 is brought into contact with the high-temperature portion in the temperature distribution detected in Step S5, and the process proceeds to Step S8.

Step S8: It is determined whether or not it is close to the completion of the printing operation. Whether it is close to the completion of the printing operation, for example, is determined based on whether or not the number of remaining prints is less than a reference number of sheets (a small number of sheets, for example, five to ten) that is arbitrarily determined. The reference number of sheets that is arbitrarily determined is set to a number for which the temperature drop of the low-temperature portion of the outer circumferential face of the fixing belt 13 does not exceed the threshold value Tth until the completion of the printing operation. In a case where the number of remaining prints is the reference number of sheets or more (No in Step S8), the process is returned to Step S5, and the process after that is repeated. On the other hand, in a case where the number of remaining prints is less than the reference number of sheets (Yes in Step S8), a printing operation corresponding to the number of remaining prints is performed, and the printing process ends.

As described above in detail based on specific examples, according to the fixing device 11 of this embodiment and the image forming apparatus including the fixing device 11, the circumferential-direction position adjusting unit 22 adjusts the circumferential-direction position of the fixing belt 13 such that the recording medium 8 is brought into contact with the high-temperature portion of the outer circumferential face of the fixing belt 13 in a case where the temperature difference ΔT between the set fixing temperature T1 and the temperature T2 of the low-temperature portion exceeds the threshold value Tth. Accordingly, before the temperature difference between the high-temperature portion and the low-temperature portion on the outer circumferential face of the fixing belt 13 increases, the temperature difference can be alleviated, whereby the occurrence of temperature unevenness in the middle of a printing operation can be effectively suppressed.

In addition, by installing a plurality of the temperature detecting units 19 along the circumferential direction of the fixing belt 13 and sharing the temperature detecting area in the circumferential direction of the circumferential face of the fixing belt 13 using the plurality of the temperature detecting units 19, the time required for detecting the temperature of the outer circumferential face of the fixing belt 13 over the entire circumference, that is, the time required for detecting the temperature distribution of the outer circumferential face of the fixing belt 13 can be shortened, and accordingly, the temperature difference between the high-temperature portion and the low-temperature portion of the outer circumferential face of the fixing belt 13 is alleviated in a speedy manner by improving the responsiveness of the circumferential-direction position adjusting unit 22, whereby the occurrence of temperature unevenness can be suppressed more effectively.

In addition, a variable-speed motor is used as the motor 25 used for driving the fixing roller 15 to rotate so as to allow the fixing belt 13 to revolve; and, by changing the speed of the variable-speed motor 25, the circumferential-direction position of the fixing belt 13 can be adjusted in a simple manner. Furthermore, in such a case, by changing the speed of the variable-speed motor 25 during a period between recording media 8 consecutively supplied to the fixing device 11, the circumferential-direction position of the fixing belt 13 can be appropriately adjusted without having a negative effect on the fixing operation.

In addition, in a case where the thickness of the recording medium 8 used for printing is large, by setting the threshold value Tth as a reference for determining whether or not the circumferential-direction position of the fixing belt 13 is adjusted by the circumferential-direction position adjusting unit 22 to a value smaller than that of a case where the thickness of the recording medium is small, the temperature difference between the high-temperature portion and the low-temperature portion can be alleviated in a speedy manner, whereby the occurrence of temperature unevenness on the outer circumferential face of the fixing belt 13 can be suppressed more effectively.

Furthermore, in a case where the conveying period t1 of the recording medium 8 and the revolving period t2 of the fixing belt 13 match each other, by setting the threshold value Tth to a value smaller than that of a case where the conveying period t1 of the recording medium 8 and the revolving period t2 of the fixing belt 13 do not match, the temperature difference between the high-temperature portion and the low-temperature portion can be alleviated in a speedy manner, whereby the occurrence of temperature unevenness on the outer circumferential face of the fixing belt 13 can be suppressed more effectively.

In addition, in a case where the length of the fixing belt 13 in the circumferential direction is shorter than the length of the recording medium 8 in the conveying direction, and one recording medium 8 is brought into contact twice with a part of the outer circumferential face of the fixing belt 13; by adjusting the circumferential-direction position of the fixing belt 13 such that the next recording medium 8 is not brought into contact twice with the portion of the outer circumferential face of the fixing belt 13 that has been brought into contact twice with the recording medium 8 supplied in advance to the fixing device 11, even in a case where one recording medium 8 is brought into contact twice with a part of the outer circumferential face of the fixing belt 13, the temperature difference between the high-temperature portion and the low-temperature portion is suppressed; whereby the occurrence of temperature unevenness on the outer circumferential face of the fixing belt 13 can be effectively suppressed.

According to the embodiment, the occurrence of temperature unevenness in the middle of a printing operation is effectively suppressed, whereby an advantage of stabilizing the fixing is acquired.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member that revolves in a circumferential direction in a heated state and transfers heat to a recording medium that is brought into contact with an outer circumferential face thereof;

a temperature detecting unit that detects a temperature of the outer circumferential face of the fixing member; and a circumferential-direction position adjusting unit that adjusts a circumferential-direction position of the fixing member such that the recording medium is brought into contact with a high temperature portion out of the high-temperature portion of the outer circumferential face of the fixing member of which temperature detected by the temperature detecting unit is relatively high and a low-temperature portion of which temperature detected by the temperature detecting unit is relatively low.

2. The fixing device according to claim 1, wherein a plurality of the temperature detecting units are installed along the circumferential direction of the fixing member, and the plurality of the temperature detecting units share a temperature detecting area in the circumferential direction of the outer circumferential face of the fixing member.

3. The fixing device according to claim 1, further comprising a variable-speed motor that drives the fixing member, wherein the circumferential-direction position adjusting unit adjusts a circumferential position of the fixing member by changing speed of the motor.

4. The fixing device according to claim 3, wherein, the circumferential-direction position adjusting unit, in a case where a plurality of the recording media are sequentially supplied to the fixing device, changes the speed of the motor in a period after a proceeding recording medium supplied to the fixing device has been discharged from the fixing device and until a next recording medium is to be supplied to the fixing device.

5. The fixing device according to claim 1, further comprising:

a position detecting unit that is installed near the temperature detecting unit and detects a marking member when the marking member passes near the temperature detecting unit; and a temperature distribution detecting unit that detects a temperature distribution of the outer circumferential face of the fixing member based on an output from the position detecting unit and the temperature detected by the temperature detecting unit, wherein the marking member is buried in the fixing member that moves in accordance with revolving of the fixing member, and wherein the circumferential-direction position adjusting unit specifies a position of the high-temperature portion based on the temperature distribution detected by the temperature distribution detecting unit.

6. The fixing device according to claim 1, wherein the circumferential-direction position adjusting unit adjusts the circumferential-direction position of the fixing member in a case where a temperature difference between a set fixing temperature that is set in advance in accordance with attributes of the recording medium that is used and the temperature of the low-temperature portion exceeds a threshold value set in advance.

7. The fixing device according to claim 6, wherein, the threshold value, in a case where a conveying period of the recording medium and a revolving period of the fixing member match each other, is set to a value less than a value that is set in a case where the conveying period of the recording medium and the revolving period of the fixing member do not match each other.

8. The fixing device according to claim 1, wherein, in a case where a plurality of the recording media are sequentially supplied to the fixing device; a length of the fixing member in the circumferential direction is shorter than a length of the recording medium in a conveying direction; and one recording medium is brought into contact with a part of the outer circumferential face of the fixing member twice, the circumferential-direction position adjusting unit adjusts the circumferential-direction position of the fixing member such that a next recoding medium is not brought into contact twice with a part of the outer circumferential face of the fixing member that has been brought into contact twice with the recording medium supplied in advance to the fixing device.

9. An image forming apparatus comprising:

the fixing device according to claim 1.

10. A method of controlling a fixing device including a fixing member that revolves in a circumferential direction in a heated state and transfers heat to a recording medium that is brought into contact with an outer circumferential face, the method comprising:

detecting a temperature of the outer circumferential face of the fixing member by using a temperature detecting unit; and adjusting a circumferential-direction position of the fixing member such that the recording medium is brought into contact with a high temperature portion out of the high-temperature portion of the outer circumferential face of the fixing member of which temperature detected by the temperature detecting unit is relatively high and a low-temperature portion of which temperature detected by the temperature detecting unit is relatively low, by using a circumferential-direction position adjusting unit.

* * * * *